US006644382B1

(12) United States Patent
Aoyama et al.

(10) Patent No.: US 6,644,382 B1
(45) Date of Patent: Nov. 11, 2003

(54) CASTING SAND SHAKE-OUT METHOD AND ITS APPARATUS

(75) Inventors: Yoshitaka Aoyama, 20-11, Makitsukadai 2-cho, Sakai-shi, Osaka-fu (JP); Shoji Aoyama, Sakai (JP)

(73) Assignee: Yoshitaka Aoyama, Osaka (JP)

( * ) Notice: Subject to any disclaimer, the term of this patent is extended or adjusted under 35 U.S.C. 154(b) by 0 days.

(21) Appl. No.: 09/331,200

(22) Filed: Jun. 25, 1999

Related U.S. Application Data

(63) Continuation-in-part of application No. PCT/JP98/05596, filed on Dec. 10, 1998.

(30) Foreign Application Priority Data

Dec. 13, 1997 (JP) ..... 9-369850
Jan. 10, 1998 (JP) ..... 10-035324
Apr. 17, 1999 (JP) ..... 11-147059

(51) Int. Cl.[7] ..... B22D 29/00

(52) U.S. Cl. ..... 164/131; 164/132; 164/260; 164/344; 164/345; 164/346; 164/401; 164/404

(58) Field of Search ..... 164/131, 132, 164/260, 345, 404, 401, 344, 346

(56) References Cited

U.S. PATENT DOCUMENTS 4,718,473 A 1/1988 Musschoot ..... 164/132
5,201,812 A 4/1993 Goss ..... 164/404
5,758,713 A * 6/1998 Fallet ..... 164/404

FOREIGN PATENT DOCUMENTS

| | | |
|---|---|---|
| EP | 0 304 683 | 3/1989 |
| FR | 2 730 436 | 8/1996 |
| GB | 2 063 789 | 6/1981 |
| GB | 2 067 938 | 8/1981 |
| GB | 2 203 682 | 10/1988 |
| JP | 2-11659 | * 1/1990 |

OTHER PUBLICATIONS

Working Translation of Japanese Utility Model Application published under No. 2–11659; Date of Publication: Jan. 24, 1990; 5 pages.

Cover Sheet of Japanese Patent Appln. No. 2–11659, Jan. 1990.

Abstract of JP 9108821, Apr. 1997.

Abstract of JP 8117968, Oct. 1994.

Abstract of JP 6047524, Feb. 1994.

* cited by examiner

*Primary Examiner*—Tom Dunn
*Assistant Examiner*—I.-H. Lin
(74) *Attorney, Agent, or Firm*—Arent Fox Kintner Plotkin & Kahn, PLLC

(57) ABSTRACT

A casting 31 is fixed to a support member 23, and the casting 31 is hit by a hammer 43 while vibrating the support member, so that vibrations of different properties are applied to the casting to shake out the sand.

12 Claims, 9 Drawing Sheets

CASTING SAND SHAKE-OUT METHOD AND ITS APPARATUS

This application is a Continuation-in-Part Application of International Application No. PCT/JP98/05596 filed on Dec. 10, 1998.

BACKGROUND ART

The present invention relates to shake-out of casting sand, and more particularly to an effective shake-out method of casting sand by characterizing the properties of vibrations given to the casting.

The prior art considered to be closest to the present invention is disclosed in Japanese Laid-open Utility Model No. 2-11659. Explaining its outline according to FIG. 8, a frame 3 is fixed on a stationary member 1 through an elastic piece 2, lower ends of plate springs 4 disposed in an oblique direction are coupled to the frame 3, and upper ends of the plate springs 4 are coupled to the lower surface of a conveyor 5. The conveyor 5 is formed of a long plate, and its section is open upward in a pi-shape. The conveyor 5 is provided with vibrations for conveying, and vibrating means 6 is provided for this purpose. That is, a support shaft 8 is attached to a bracket 7 fixed on the frame 3, and a rotating plate 9 is fixed on this shaft 8. A belt 11 is applied between a motor 10 coupled on the frame 3 and the rotating plate 9, and one end of a conduction rod 12 is linked to an eccentric shaft 13, and other end of the rod 12 is linked to a fixed shaft 14. The fixed shaft 14 is fitted to a bracket 15 welded to the lower side of the conveyor 5.

When the rotating plate 9 is rotated by the motor 10, the conveyor 5 is vibrated in the lateral direction in the diagram by means of the eccentric shaft 13 and conduction rod 12. At this time, deflecting in the falling direction and standing direction of the plate springs 4, the conveyor 5 sinks rightward in the falling direction, whereas the conveyor 5 rises leftward in the standing direction. Therefore, a casting 16 on the conveyor 5 is fed leftward in the diagram by the standing motion components of the plate springs 4.

A hammer 17 is fixed to the upper side stationary member 1, and a chisel 19 is fixed at the end of its operation rod 18. As castings 16 are fed successively by the conveying vibration of the conveyor 5, the hammer 17 hits the castings 16 to shake out the sand. Since the casting is vibrated on the conveyor 5, the sand remaining on the casting 16 is shaken out.

The casting 16 on the conveyor 5 is only moved by vibration, and the vibration itself is not utilized sufficiently. That is, it is not utilized directly in the action for collapsing the solidified sand and core in the recess of the casting 16 and separating them from the casting. Yet, by hitting the casting 16 on the conveyor 5 by the hammer 17, the plate springs 4 are loosened, and the impact applied to the casting 16 is lessened, and the sand is not shaken out sufficiently.

Japanese Laid-open Patent No. 61-33762 discloses a sand shake-out method by applying vibration while inclining the casting. Its outline is shown in FIG. 19, and it is explained in the first place. A casting 103 is suspended on a guide rail 101 by a hanger 102, and is transferred in the vertical direction to the sheet of paper of FIG. 19. An L-shaped rotary arm 106 is attached to a column 104 through a shaft 105, and a vibration plate 108 is supported by a hanger spring 107. A support spring 109 and a vibrating device 110 are installed between the vibration plate 108 and rotary arm 106. A working cylinder 111 is supported on a stationary member 113 on a shaft 112, and a cylinder rod 114 is coupled to the lower part of the rotary arm through a shaft 115. A distance piece 116 is fixed to the vibration plate 108.

Explaining the operation of this device, in the shown state, vibration is applied to the casting 103 by inclining it, and while this device is not operating, since the piston rod 114 of the working cylinder 111 is contracted, the rotary arm 106 is erect in the vertical direction, and hence the vibration plate 108 is also erect. In this state, when the casting 103 is moved as being suspended in the vertical direction and stops before this device, this time, the rotary arm 106 is inclined by the output of the working cylinder 111, and the vibration plate 108 is also inclined simultaneously with the casting 103. In this state, the vibration plate 108 vibrates to separate the sand sticking to the casting 103.

The basis concept of this prior art is to push the casting 103 suspended in the vertical direction from the side and press the casting 103 to the vibration plate 108. Therefore, this pressing force is determined by the mass or inclination angle of the casting 103. When the vibration plate 108 vibrates in such condition, the casting 103 receives vibrations, but since the casting 103 is suspended, the pressing force is small, and sufficient vibrations are not transmitted to the casting 103, and thereby separation of the sand is insufficient. Moreover, since the casting 103 is not fixed on the vibration plate 108, when the vibration plate 108 vibrates, the casting 103 is set in an escaping phenomenon, and finally the casting 103 is not vibrated sufficiently. Yet, the direction of inclination is either the direction as shown in FIG. 19 or its reverse direction, and the sand may not be separated completely depending on the shape of the casting 103. In particular, the direction of inclination is important in collapse and discharge of core sand.

SUMMARY OF THE INVENTION

It is an object of the invention to solve the aforesaid problems, and bring about better effects by selecting the direction of vibration depending on the shape of the casting or other conditions. The sand shake-out method of the invention is characterized by fixing the casting on a support member, and hitting the casting by a hammer while vibrating this support member. By fixing the casting on the support member, and vibrating the support member in this state, a strong vibration is transmitted to the casting, and motion components for separating the sand from the casting are obtained powerfully. Since the casting exposed to such vibrating state is hit by the hammer, the sand is separated by the impulsive motion energy. In particular, the vibration applied to the support member is a so-called micro-vibration of high frequency and small amplitude, while hitting by hammer is low in frequency but is extremely high in the impact of single blow, and by combination of properties of such vibrations, destruction and separation of sand are effected by vibration of the support member, and the stubborn sand sticking to the casting can be separated from the casting by the strong impact force of the hammer.

The vibration applied to the support member is intended to have a conveying performance in one direction, and the sand sticking to the inside and outside of the casting is separated by this vibration from the casting and discharged, and an impulsive vibration is also given to the casting by the hammer to send out the sand falling on the support member in one direction, so that the separating direction and discharging direction of the casting sand can be appropriately set by the vibrating characteristic having the conveying performance depending on the shape of the casting.

The support member may be divided into two sections, and the casting may be fixed on both support members, and only one support member may be vibrated, and in this case, when either support member is vibrated, its vibration is transmitted to the other support member through the casting, and, as a result, both support members vibrate similarly, so that the vibration on the casting is obtained in a specified manner.

When the support member is divided into two sections, the casting may be also fixed on both support members and both support members may be vibrated, and in this case a stronger motion energy is applied to the casting by vibration of the both.

The vibration applied to both support members has a conveying performance in one direction, conveying directions of vibrations of both support members are set in mutually opposite directions, and after a vibration in one direction is applied to one support member depending on the shape of the casting, a vibration having a conveying performance in opposite direction is applied to other support member. In this method, first the sand is discharged in one direction depending on the shape of the casting, and then the sand is discharged in other direction.

The casting sand shake-out apparatus of the invention comprises a support member to which a casting is fixed, means for vibrating the support member, and a hammer for hitting the casting, in which the sand sticking to the inside and outside of the casting is separated from the casting and discharged by the vibrating means, and an impulsive vibration is applied to the casting by the hammer, thereby promoting the separating action. Since the casting is fixed to the support member, the vibration applied to the casting is powerful, and moreover by hitting by the hammer while vibrating, the sand can be separated from the casting impulsively. Thus, the combination of such micro-vibration and impulsive vibration functions effectively for shaking out the sand.

The support member is composed of a receiving plate, and the hammer is coupled to this receiving plate, and an elastic piece is inserted in any position between the hammer and the receiving plate. By the hammer coupled to the receiving plate, a powerful hammer impact force is obtained, and, on the other hand, in consideration of possibility of the impact reaction of the hammer becoming excessive, the elastic piece is inserted, so that damage of the apparatus is avoided.

The vibration of the vibrating means may also have a conveying performance in one direction, and in this case, by matching the shape of the casting and the direction of conveying performance, the sand separated from the casting is smoothly discharged outside, and moreover the sand on the receiving fuck you lucky plate is conveyed by vibration and sent outside of the apparatus.

Further, the receiving plate may be divided into two sections, and the casting is fixed on both, and both receiving plates are provided with vibrating means individually so that either receiving plate may be vibrated. When either support member is vibrated, its vibration is transmitted to the other support member through the casting, and finally both support members vibrate similarly, so that a specified form of vibration is applied to the casting.

The receiving plate may be divided into two sections, and the casting is fixed on both, and both receiving plates are provided with vibrating means individually so that both receiving plates may be vibrated. By vibration of the both, a stronger motion energy is given to the casting.

The conveying directions of vibration of both receiving plates may be set in mutually opposite directions. After a vibration in one direction is applied to one support member depending on the shape of the casting, a vibration having a conveying performance in opposite direction is applied to other support member, and the sand is first discharged in one direction depending on the shape of the casting, and then the sand is discharged in other direction.

It may further include fixing means for firmly fixing the casting to the receiving plate. By such fixing, the vibration of the receiving plate is completely transmitted to the casting.

The fixing means may be composed of a fixing mechanism attached to the receiving plate for pressing the casting toward the receiving plate. By pressing the casting firmly against the receiving plate, the casting and receiving plate are more securely united into one body.

The fixing means may be constituted by a fixing mechanism attached to the receiving plate for pressing the casting toward the receiving plate, and a fitting relation between a protruding member provided in the receiving plate and a recess in the casting. By the combination of pressing and fitting, the casting and receiving plate are most securely united into one body.

In other aspect of the invention, a casting sand shake-out apparatus comprises a support member to which a casting is fixed, and one or both of means for vibrating the support member and a hammer for hitting the casting, in which the casting sand opposite to the opening of the casing is collapsed a bar member. Since the casting sand solidified in the opening is poked and broken by the bar member, the internal casting sand can be collapsed easily.

In a different aspect of the invention, a casting sand shake-out method is characterized by comprising a support member to which a casting is fixed, and one or both of means for vibrating the support member and a hammer for hitting the casting, in which the casting sand opposite to the opening of the casing is collapsed a bar member, so that the casting sand inside the casting may be easily collapsed by vibration or impact. By removing the casting sand solidified in the opening, the internal casting sand can be freely moved by vibration or impact.

In a further different aspect of the invention, a sand shake-out device of casting in which vibration or impact is applied to the casting fixed on the support member comprises an inclining means for inclining the support member in a desired direction. Therefore, the support member is inclined in a direction suited to the outer shape of the casting or the shape of the core sand, and the sand is discharged in a lower direction. After discharging the sand in a specific part by inclining in a specific direction, the direction of inclination is changed, and the sand in other part is separated and discharged. Thus, by inclining the casting while giving vibration or impact depending on the shape of the casting and the direction of the opening, positive collapse and separation of sand will be promoted, and smooth discharge of sand to the lower side is realized.

The support member may be disposed on vibrating means installed on a foundation member, and the inclining means is installed on the foundation member, so that by inclining the foundation member in a desired direction, all of the vibrating means, support member and casting are inclined in the desired direction. Thus, the casting can be freely inclined in a desired direction, so that the sand is discharged smoothly by inclination.

The entire device may be inverted, which in combination with the discharge of sand by inclination, ensures that the remaining sand is completely discharged. It is designed to invert the entire device, and therefore, in addition to discharge of sand by inclination, the casting is inverted, so that the remaining sand is completely discharged. In addition to discharge of sand by inclination, vibration and impact as mentioned above, the sand is discharged by force by inverting. By combination of vibration, hammer impact, inclination and inversion, collapse and discharge of sand will be more effective.

A hammering means may be provided for hitting the casting, so that in addition to the vibration of high frequency being applied, an impulse force is applied to the casting by the hammer. By such combination method, while collapsing and separating the sand, the casting is inclined in a desired direction, so that the sand shake-out is perfect.

According to an embodiment of the invention, a sand shake-out device for casting in which vibration or impact is given to the casting fixed on a support stand comprises a support stand disposed at the upper side of a vibrating device installed on a platform, an inclining device disposed at the lower side of the platform, and hammering means for giving impact to the casting. Therefore, the sand is discharged in a lower direction by inclining the support stand in a direction suited to the outer shape of the casting or the shape of the core sand. After discharging the sand in a specific part by inclining in a specific direction, the direction of inclination is changed, and the sand in other part is separated and discharged. By inclining the platform in a desired direction, all of the vibrating means, support stand and casting are inclined in the desired direction. In addition to the vibration of high frequency being applied, an impulse force is applied to the casting by the hammer. By such combination method, while collapsing and separating the sand, the casting is inclined in a desired direction, so that the sand shake-out is perfect.

DESCRIPTION OF PREFERRED EMBODIMENTS

Figure 8:
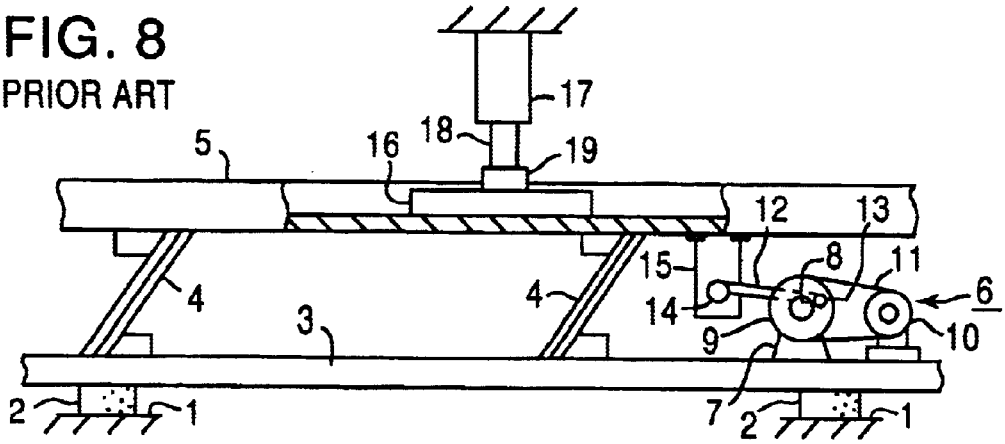
FIG. 8 PRIOR ART
FIG. 8 is a side view showing a prior art.

Explaining the preferred embodiment of the invention shown in FIG. 1 to FIG. 4, an iron-made base plate 22 is supported on a stationary member 20 through an elastic rubber 21, and an iron-made receiving plate 23 is disposed thereabove as a support member. Vibrating means 24 for vibrating the support member 23 is disposed between the support member 23 and the base plate 22. This vibrating means 24 may be realized by various forms, such as a combination of plate springs and vibration exciting device in the horizontal direction, a form as shown in FIG. 8, or a combination of plate springs and electromagnet, and the third type is employed herein. Plate springs 25 made of steel plates disposed at an inclination in an oblique direction are disposed in a total of four pieces as clear from FIG. 1 or FIG. 2. The lower end of each plate spring 25 is coupled to the base plate 22 through a coupling bracket 26, and the upper end is coupled to the lower side of the receiving plate 23 through the bracket 26. This coupling bracket 26 is not shown in detail in the drawing, but an iron piece on the block is welded to the base plate 22, and a bolt penetrates through the plate spring 25, and is fastened to the coupling bracket 26 by screwing.

An electromagnet 27 is disposed in order to pull the receiving plate 23 downward, and an iron core 29 is placed in an electromagnetic coil 28, and an iron piece 30 forming a pair therewith is fixed at the lower side of the receiving plate 23, and a specified clearance is set against the iron core 29. As a hammer described later is indirectly coupled to the receiving plate 23, it is designed so that the hammer action may not affect the clearance. If the hammer is indirectly coupled to the base plate 22, reaction by hitting by the hammer causes to push down the receiving plate 23, and the clearance may be changed. An intermittent current passes in the electromagnetic coil 28, and its exciting action should not cause the clearance to be changed by other factor. It means that the hitting reaction by the hammer should not cause to deviate the clearance. The vibration applied to the support member 23 is a region of so-called micro-vibration of high frequency and small amplitude, and, for example, the amplitude is 0.2 mm and frequency is 60 cycles per second.

Figure 2:
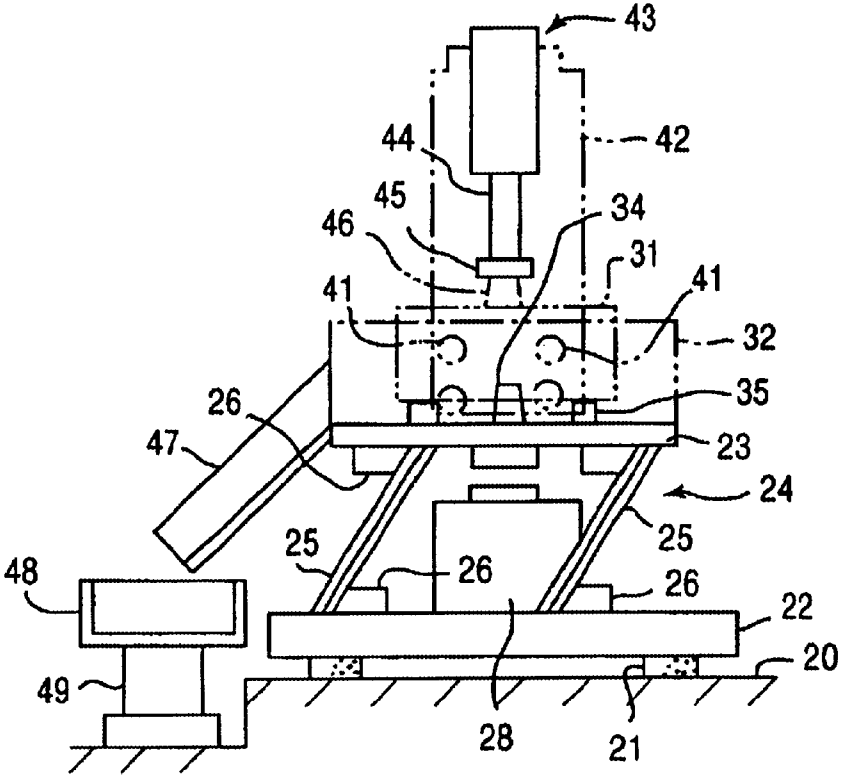
FIG. 2 is a side view of the apparatus in FIG. 1.
Figure 3:
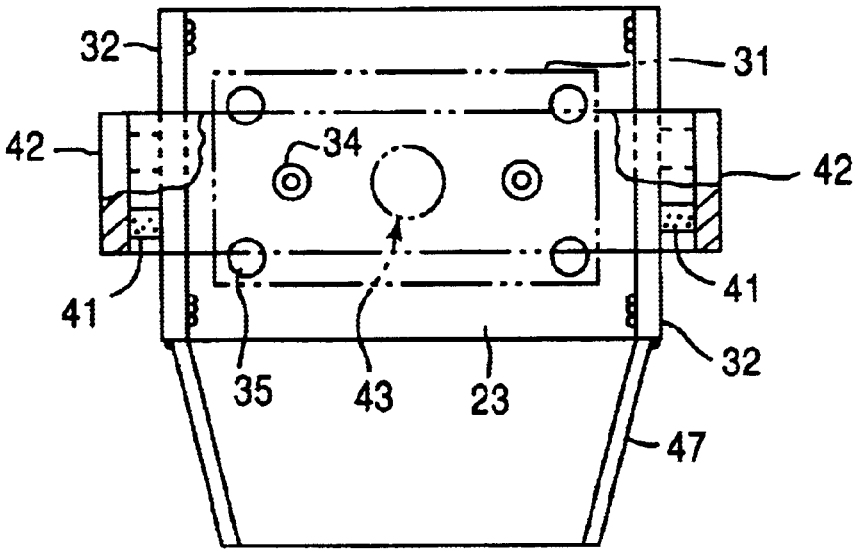
FIG. 3 is a plan view of the apparatus in FIG. 1.

That the vibration applied to the support member has a conveying performance in one direction means the same as already explained in relation to FIG. 3 showing the prior art. That is, when the iron piece 30 is pulled down, the plate spring 25 is elastically deflected rightward in FIG. 2 while the receiving plate 23 is being pulled down, and at this time the receiving plate 23 is dislocated in a lower direction, and when attraction of the electromagnet 28 is cleared, the plate spring 25 is about to move back to the original position, while the receiving plate 23 is dislocated leftward while moving up. By this leftward elevating dislocation, the member put on the receiving plate receives a leftward motion component, so that a conveying performance in the leftward direction is expressed.

The casting fixed on the support member 23 is indicated by reference numeral 31. The variety of the casting 31 is not particularly specified, and this is an example of aluminum cylinder head of an internal-combustion engine with a displacement of 1800 cc. Transverse-plates 32 are welded to right and left sides of the receiving plate 23, and fixing mechanisms 33 (schematically shown) are installed on the transverse plates 32, and the casting 31 is designed to be pushed toward the receiving plate 23 by their pushing function. To integrate the receiving plate 23 and casting 31 more securely, a protruding member 34 of the receiving plate 23 is fitted into a recess in the casting 31. Actually, the protruding member 34 is a taper pin as shown in the drawing, and the recess is an oil hole of the cylinder head. Positioning pins 5 are provided at least in four positions on the receiving plate 23, and the casting 31 is placed thereon.

Figure 4:
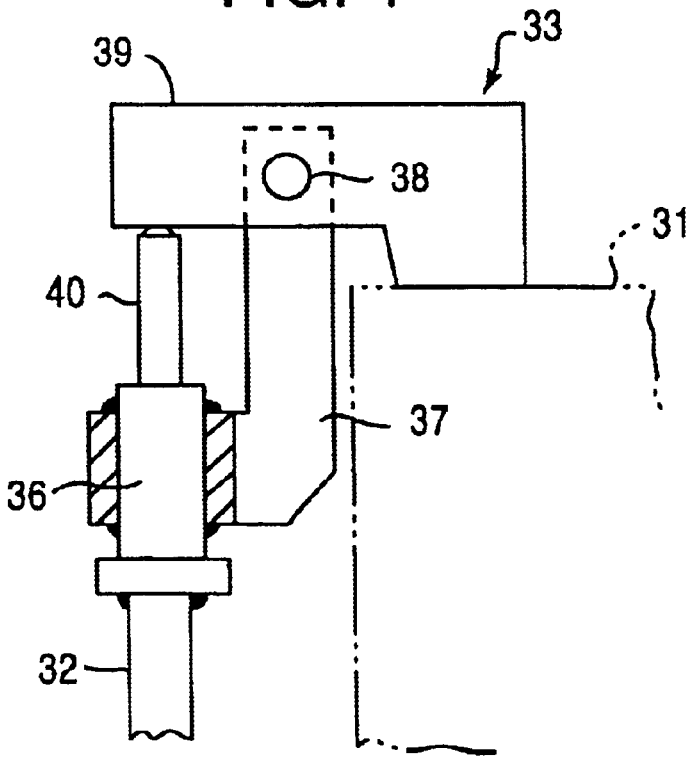
FIG. 4 is a front view of a fixing mechanism shown in FIG. 1.

An actual example of the fixing mechanism 33 is shown in FIG. 4, in which an air cylinder 36 is fixed on the upper end of the transverse plate 32, and a bracket 37 extending upward is coupled to its outside. A presser arm 39 is rotatably supported on a shaft 38 fixed to this bracket 37, and it is designed so that a piston rod 40 of the air cylinder 36 may push up the presser arm 39. Although not shown in the drawing, a helical coil spring is assembled in the shaft 38 so that the presser arm 39 may return in the counterclockwise direction when the piston rod 40 moves backward.

A portal frame 42 is coupled to the transverse plate 32 through an elastic rubber 41, and a hammer 43 is fixed thereon. The hammer 43 is designed to produce impact outputs continuously, and is operated by compressed air. A chisel 45 is fixed at the leading end of its output shaft 44, and it is designed to hit part of the casting 31 continuously. Since this casting 31 is a cylinder head, it is preferred that the chisel 45 coincides with a riser portion 46 when casting because the product portion of the casting 31 is not damaged. The elastic rubber 41 may be provided at any position between the hammer 43 and the receiving plate 23, and therefore it may be provided somewhere between the hammer 43 and the frame 42. The hammer 43 may be indirectly coupled to the receiving plate 23, so that the impulsive reaction of the hammer 43 may be received by the receiving plate 23.

Figure 1:
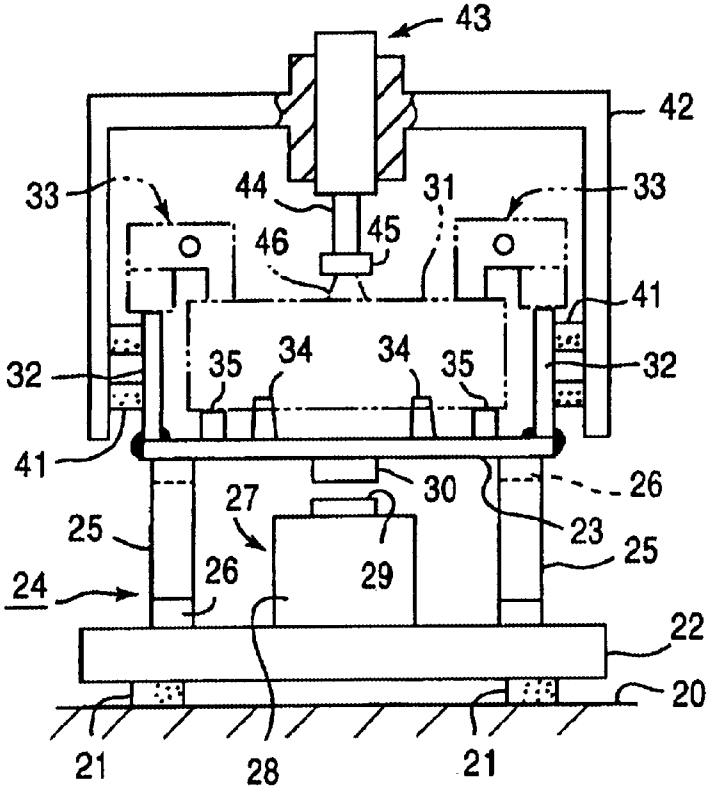
FIG. 1 is a front view of an apparatus of the invention.
Figure 1A:
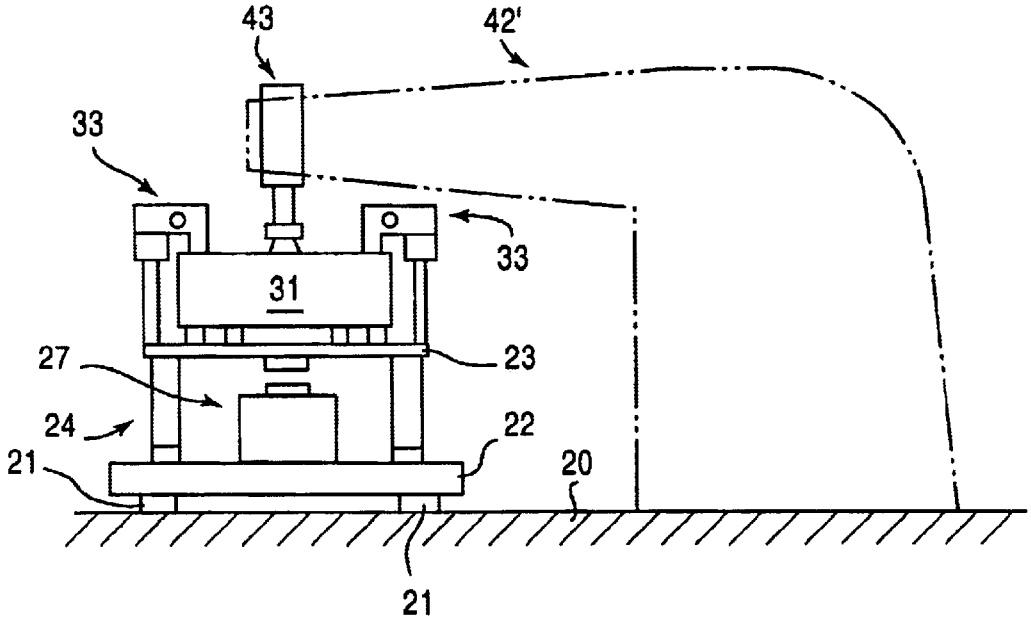
FIG. 1A is a view similar to FIG. 1, showing a modification of the apparatus shown in FIG. 1.

FIG. 1A shows a modification in which the hammer 43 is supported on a frame 42 upright on the stationary member 20.

The vibration of the hammer is different from the vibration of the support member, and its frequency is, for example, 30 cycles per second, and the length of vibration stroke of the hammer is set at 10 mm in order to obtain a strong impulsive energy, and hence it is different in nature from the vibration of the support member.

In FIG. 2 and FIG. 3, the fixing mechanism 33 is not shown. Moreover, when the opening of the water jacket of the cylinder head is opened in the conveying direction, the collapsed sand is smoothly discharged from the opening. Consideration of vibrating direction and shape of the casting means such convenience.

Explaining the action of this embodiment, the cylinder head 31 is put on the positioning pins 35 while matching with the taper pins 34, and the air cylinder 36 of the fixing mechanism 33 is operated to push the presser arm 39 to the top of the cylinder head 31, and the receiving plate 23 and cylinder head 31 are integrated securely. Then the vibrating means 24 is put in operation, so that a conveying vibration acts on the cylinder head 31, and the core and other sand forming the water jacket in the cylinder head 31 begin to collapse, and the sand is discharged in the conveying direction of vibration. Simultaneously with this vibration, an impulsive vibration is applied to the casting 31 by the hammer 43, and the core and casting sand are securely collapsed to be discharged outside of the casting. The sand sticking to the surface of the casting 31 is also separated securely by these two kinds of vibrations. The sand thus falling on the receiving plate 23 is dropped into a receiving box 48 from a chute 47 by the conveying performance of the vibrating means 24. Observing from the properties of the vibration, since the micro-vibration applied to the support member is high in frequency, more continuous vibrations are applied to the casting per unit time, and therefore the sand collapsed by this vibration characteristic and separated from the casting wall is completely discharged. However, the stubborn sand sticking to the wall of the casting is separated by a strong impulsive force of the hammer. Of course, this strong impulsive force is combined with the micro-vibration of the support member to contribute to effective sand shake-out.

The hitting reaction of the hammer 43 is transmitted from the frame 42 to the receiving plate 23 by way of the elastic rubber 41 and transverse plate 32, and an excessive. impulsive force is absorbed by deformation of the elastic rubber 41, so that breakage in the stress concentrated area is prevented.

Figure 5:
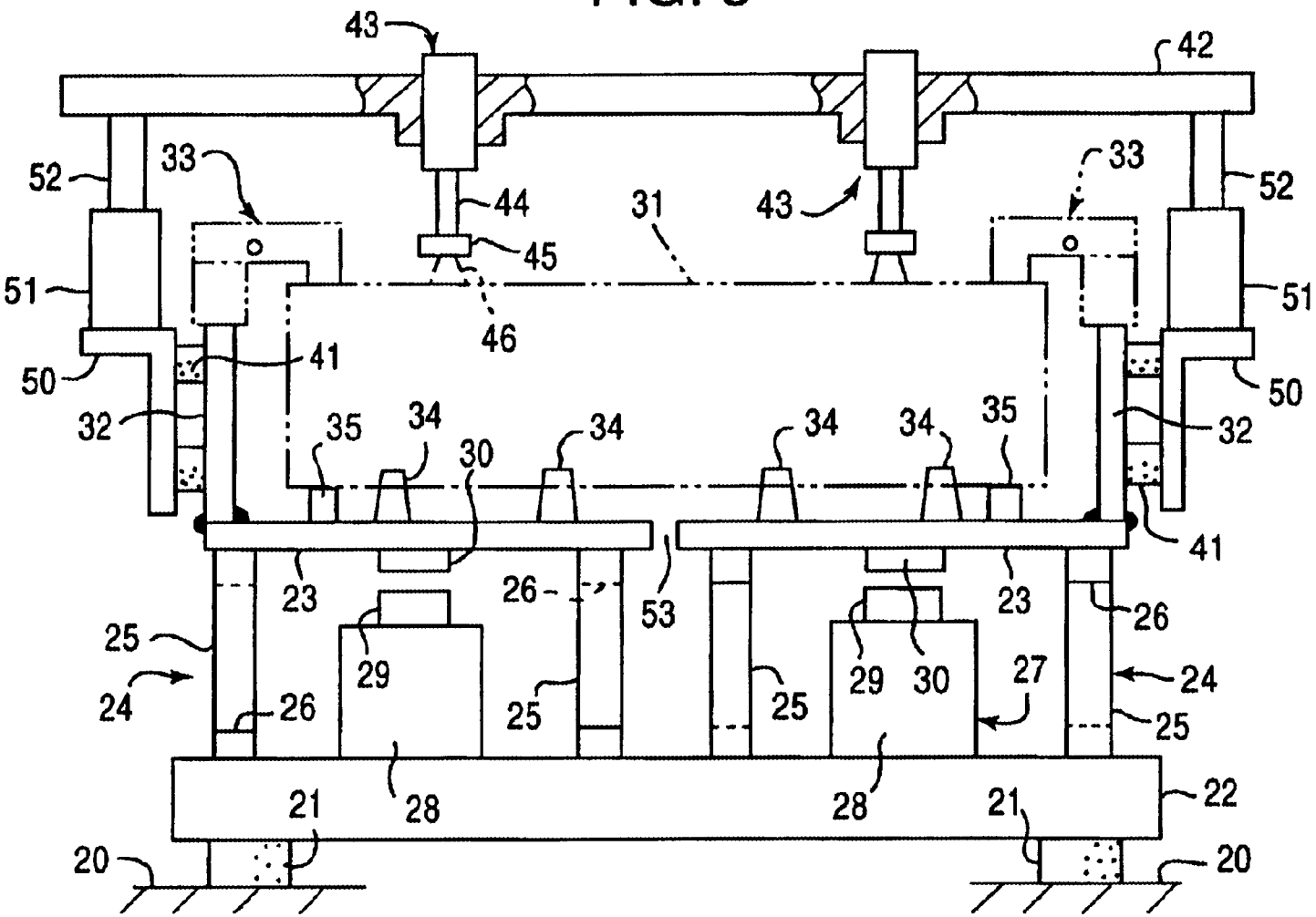
FIG. 5 is a front view showing other embodiment.
Figure 6:
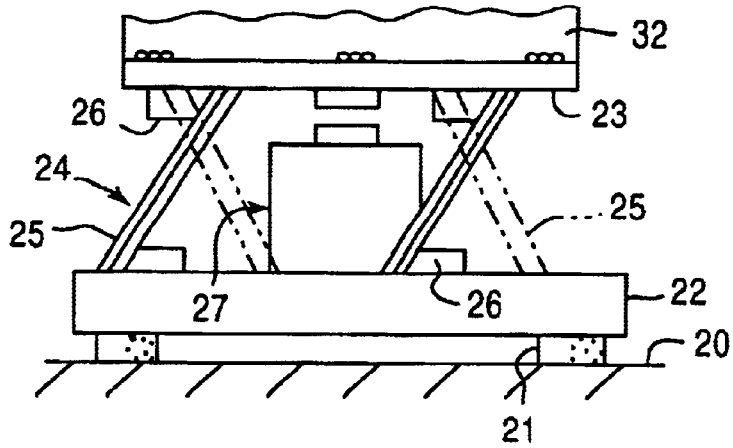
FIG. 6 is a partial side view of the apparatus in FIG. 5.
Figure 7:
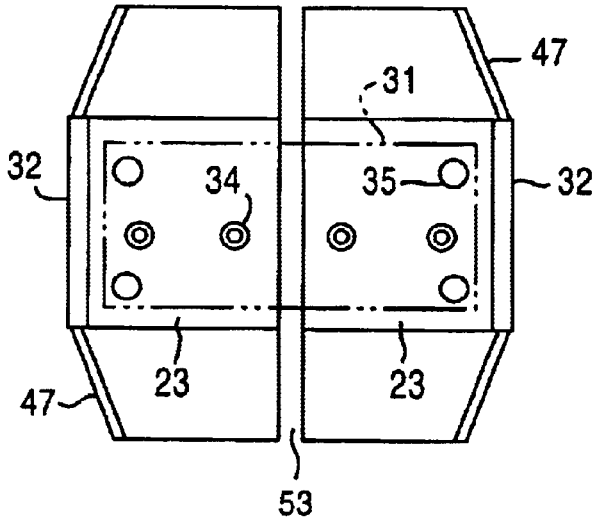
FIG. 7 is a partial plan view of the apparatus in FIG. 5.

Other embodiment is shown in FIG. 5 to FIG. 7, in which members having same functions as in the foregoing embodiment are identified with same reference numerals, and duplicate explanations are omitted.

A support bracket 50 of an L-section is coupled to a transverse plate 32 through an elastic rubber 41, and air cylinders 51 are fixed thereon. A frame 42 straight in the horizontal direction is coupled to piston rods 52 of the air cylinders 51. What is most characteristic in this embodiment is that the support member 23 is divided into two sections, and that the both support members 23 are provided with vibrating means 27 individually, and moreover that the conveying directions of vibrations on the support members 23 are opposite to each other.

As clear from the drawings, the receiving plate 23 is divided into two sections, and four plate springs 25 and one electromagnetic coil 28 are disposed each at the lower side of the receiving plates 23, and two taper pins 34 are provided respectively. Thus, the two plates are furnished similarly, and therefore if one receiving plate 23 is vibrated, in order to transmit its vibration securely to the other receiving plate 23 not vibrated, it is intended not to cause relative dislocation between the receiving plates 23 and the cylinder heads 31. To set the conveying directions of the receiving plates 23 oppositely, the inclination directions of the plate springs 25 are set as shown in FIG. 6, in which one inclination is indicated by solid line and other inclination is indicated by twin dot chain line so as to be opposite to each other. Or, as shown in FIG. 7, chutes 47 are disposed at both sides. Although not shown, in order to minimize the amount of sand falling through a clearance 53 formed between the two receiving plates 23, it is also effective to incline the receiving plates 23 so that the side of the clearance 53 may be higher than the side of the transverse plates 32 in FIG. 5.

The action of this embodiment is described below. When only one receiving plate 23 is vibrated, its vibration is transmitted to the other receiving plate 23 not vibrated through the casting 31, and therefore the entire casting 31 receives the vibration having a conveying performance in one direction, and the sand is discharged to the direction of one side. Of course, this vibration of the receiving plate is simultaneously accompanied by the hitting action by the hammer 43. When sand discharge in this direction is terminated, this time, the other receiving plate 23 only is vibrated, and the sand is discharged in the reverse direction by the conveying performance in reverse direction.

Alternatively, when the two receiving plates 23 are vibrated simultaneously, in FIG. 7, the casting 31 repeats rotary vibrations in the clockwise direction and counter-clockwise direction around its central part, and the combined vibration of the two receiving plates is transmitted to the casting 31.

In this embodiment, meanwhile, all plate springs may be inclined in a same direction.

The structure of the apparatus is as shown in the drawings, and a different embodiment is further described. That is, at the beginning, the support member 23 is not vibrated, and a hitting impact is given to the casting 31 only by the hammer 43, and the solid core and other sand are collapsed and separated from the casting wall, and after stopping the impact action of the hammer 43, a conveying vibration of the support member 23 is generated, and the loosened sand in the casting is discharged from the opening of the casting 31. Or, without stopping the vibration of the hammer 43, it is also possible to start vibration of the support member 23 in a certain time after start of operation of the hammer 43.

In the sand shake-out method by such operation, the two different vibrations are mutually related, that is, the impact action of the hammer is mainly responsible for collapse and separation of sand, and the vibration of the support member is mainly responsible for discharge of sand, and therefore it is effective when the core is left over in the casting in a solid form. That is, the solid sand is first collapsed by the strong hammer impact, and then the sand is discharged by the support member, and it is particularly advantageous when the sand is sticking to the casting in a solid lump form.

Figure 9:
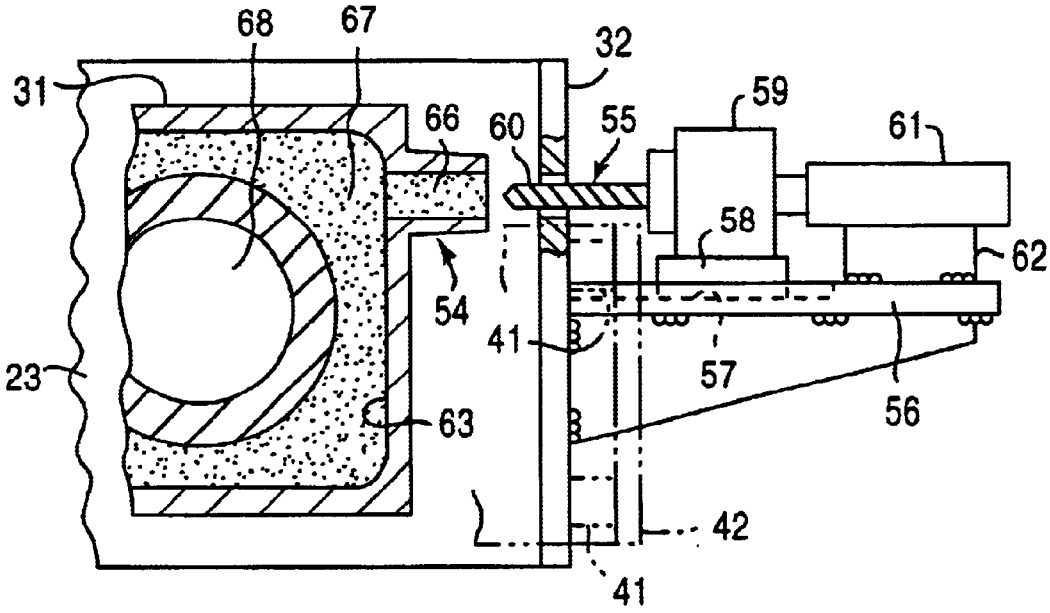
FIG. 9 is a partial plan view showing another embodiment.

A further different embodiment shown in FIG. 9 is described. Herein, members having same functions as in the foregoing embodiments are identified with same reference numerals in FIG. 9, and duplicate explanations are omitted. In the case of a cylinder head of an engine as in this drawing, an opening 54 of its water jet is tubular, and it is stuffed with casting sand of the core like a solid plug, and the internal casting sand continuous to this portion is hardly collapsed by impact or vibration. Accordingly, when the solidified sand in the opening 54 is poked and broken by a bar member 55, and the sand in the tubular portion and inner part is collapsed, the sand in the casting is easily moved inside by vibration or impact, and is moved loosely within the water jacket, and it is collapsed loosely and finely. Herein, as the bar member, for example, drill, borer, gimlet, pestle and others in various forms or motions for collapsing sand may be considered, and an example of drill is shown. That is, a support plate 56 is firmly welded to a transverse plate 32, and a slide member 58 is fitted into a groove 57 formed therein so as to be free to move forward or backward, and a conduction motor 59 is mounted on this member 58, thereby rotating a drill 60. To move the drill 60 back and forth, an air cylinder 61 is fixed firmly on the support plate 56 through a bracket 62. When advanced leftward by the air cylinder 61 while rotating the drill 60, the sand in the opening 54 is collapsed and when the drill 60 is further moved inward, the collapsing phenomenon propagates to the inner parts of the opening 54. In this way, the internal sand in the opening 54 and its vicinity is collapsed, and it is easily loosened by vibration or impact. Reference numeral 63 denotes a water jacket, 66 the sand in the opening 54, 67 the sand at the inner side of the sand 66, and 68 denotes the space in the upper part of the combustion chamber.

Figure 10:
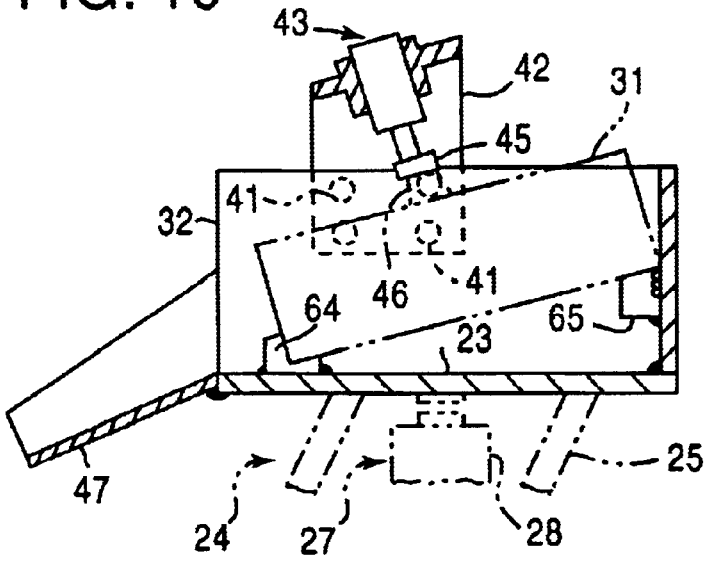
FIG. 10 is a longitudinal sectional view showing a further different embodiment.

In an embodiment shown in FIG. 10, a cylinder head 31 is installed obliquely, and vibration or impact is applied thereto. Therefore, blocks 64 and 65 are provided for supporting the casting 31. When vibration or impact is applied in an inclined state, discharge of sand is promoted even in a labyrinth of water jacket.

It is preferred, from the viewpoint of productivity, to install the apparatuses shown in FIG. 1, FIG. 9 and FIG. 10 in a line and remove sand by distributing roles among the apparatuses.

According to the invention, since the casting is fixed on the support member and the support member itself is vibrated, the vibration to the casting is efficiently transmitted, and it is very effective for collapse, separation or drop, of sand. Moreover, simultaneously with vibration of the casting by the support member, the casting is hit by a hammer, and it is very effective for collapse of sand solidified keep in the casting or separation of sand from the casting. The invention has excellent effects by applying two kinds of vibrations to the casting efficiently and simultaneously. Moreover, the vibration applied to the support member is a micro-vibration and the vibration by the hammer is a strong impact, so that the sand can be discharged effectively.

The vibration applied to the support member or the receiving plate has a conveying performance in one direction, and therefore by matching the conveying direction and the shape of the casting, the sand can be smoothly discharged from the casting.

Since the hammer is indirectly coupled to the receiving plate, the impulsive reaction of the hammer is received by the receiving plate, and adverse effects on the vibrating means or others may not occur. Moreover, the elastic piece is inserted in any position between the hammer and the receiving plate, and therefore if the impulsive reaction of the hammer is excessive, damage of the structural members is avoided by the absorbing action of the elastic piece.

The support member or receiving plate is divided into two sections, and each is provided with vibrating means, and therefore if either receiving plate is vibrated, its vibration is transmitted to the other receiving plate to vibrate through the cast in a solid state, so that the entire casting is vibrated to separate and discharge the sand. As each vibrating means is provided with a direction of conveying performance, the sand discharge direction may be set in a specific direction, which is very advantageous for discharge of sand. By setting the conveying directions of the two vibrating means in mutually opposite directions, after completion of sand discharge in one direction, sand discharge in other direction can be started, and the sand can be smoothly discharged in two directions depending on the shape of the casting.

Fixing means for fixing the casting to the receiving plate is installed, and the casting and receiving plate can be integrated firmly, and therefore vibration may be efficiently applied to the casting. Still more, by combination of the fixing mechanism for pressing action installed on the receiving plate with the fitting relation between the protruding member provided in the receiving plate and the recess in the casting, fixing of the casting on the receiving plate is perfect.

As shown in FIG. 9, by moving the bar member forward into the opening of the casting, the casting sand solidified in the opening can be collapsed, and by moving the bar member further into the inner parts of the casting sand, the sand in the casting is collapsed, and the internal sand is moved loosely, and is further loosened and broken, and the sand can be discharged securely. By such phenomenon, even in a complicated core such as the water jacket of the cylinder head, it is easy to collapse and discharge.

Moreover, by inclining the casting and applying vibration and impact as in FIG. 10, the smooth can be discharged more smoothly.

Figure 11:
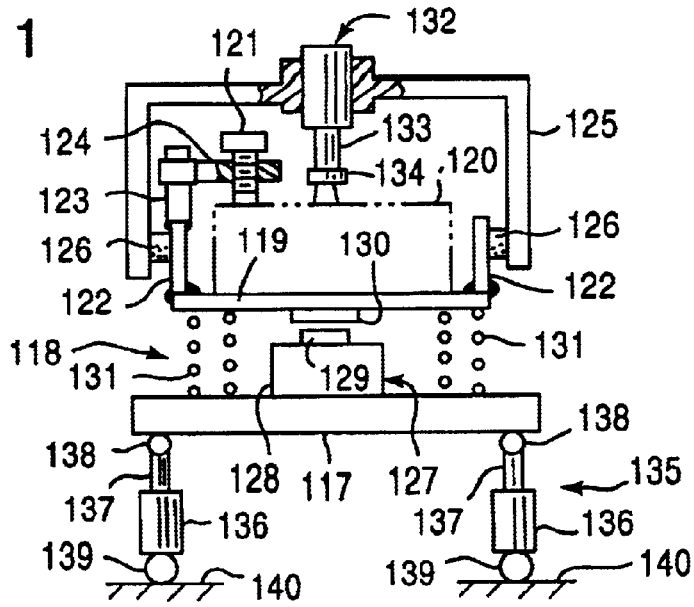
FIG. 11 is a front view showing an embodiment of the invention.
Figure 12:
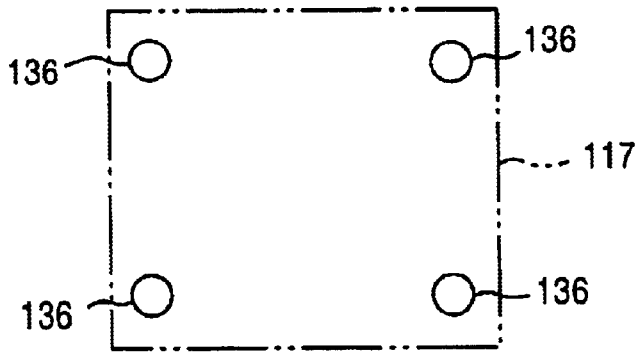
FIG. 12 is a plan view showing the relation between a platform and a hydraulic cylinder.
Figure 13:
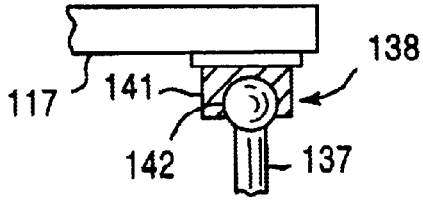
FIG. 13 is a partial sectional view showing a structure of a ball joint.

Referring now to the embodiment shown in FIG. 11 to FIG. 13, a vibrating device 118 corresponding to the vibrating means is mounted on a thick iron platform 117 corresponding to foundation member. The casting is fixed to a support stand 119 corresponding to the support member. Various fixing methods are possible, and herein the casting 120 is pressed by a fixing bolt 121. Lateral plates 122 are welded to the right and left side of the support stand 119, and a post 123 is welded on the top, and a rotatable fixing arm 124 is attached to the post 123, and the fixing bolt 121 is driven therein. In this example, the casting 120 is an aluminum cylinder head of an engine with a displacement of 1800 cc.

The vibrating device 118 is explained. An electromagnet 127 is placed on the platform 117, an iron core 129 is disposed in an electromagnetic coil 128, its pairing iron piece 130 is fixed at the lower side of the support stand 119. Compression springs 131 are disposed between the platform 117 and support stand 119. When an intermittent current is applied to the electromagnet 127, the iron piece 130 is attracted, and the support stand 119 is vibrated by the elastic force of the compression springs 131. This vibration is a feeble vibration of high frequency and small amplitude, for example, 0.2 mm in amplitude and 60 cycles per second in frequency.

Both sides of a portal frame 125 are coupled to the lateral plates 122 through elastic rubber 126. Hammering means 132 is fixed to the top of the frame 125, which is operated by compressed air to deliver impact. A chisel 134 is fixed to the leading end of its output shaft 133, and it hits part of the casting 120 continuously. The continuous impact by the hammering means 132 is different from the frequency characteristic of the vibrating device 118, and its frequency is, for example, 30 cycles per second, and the length of impact stroke of the hammer is set at 10 mm in order to obtain a strong impact energy.

An inclining device 135 corresponding to the inclining means is disposed at the lower side of the platform 117. The device 135 may be realized in various systems, and four fluid cylinders are employed herein. Hydraulic cylinders 136 are disposed at four corners of the platform 117, and the upper end of a piston rod 137 is coupled to the lower side of the platform 117 through a ball joint 138. The lower end of the hydraulic cylinder 136 is similarly coupled to a stationary member 140 through a ball joint 139. FIG. 13 shows a structure of the ball joint 138, in which a socket 141 is fixed to the lower side of the platform 117, and a ball 142 fixed to the piston rod 137 is accommodated therein. Therefore, when the four piston rods 137 are adjusted to required length individually, the cylinders 136 are inclined, but it is absorbed by the ball joints 138 and 139.

The operation of this embodiment is described. FIG. 11 shows the casting 120 is fixed firmly on the support stand 119 by the fixing bolt 121, and when the driving device 118 and hammering means 132 are operated in this state, fine vibrations are continuously transmitted to the casting 120 by the vibrating device 118. As a result, the sand and core sand sticking to the surface of the casting 120 begin to collapse and are discharged. Simultaneously with, or before or after this vibration, a powerful impact vibration is applied to the casting 120 by the hammering means 132, and the casting sand of the core and others will be securely collapsed and discharge outside of the casting. In addition to such operation of vibration and impact, the support stand 119 can be inclined in a desired direction. The inclining direction can be freely selected by controlling the flow rate to the four hydraulic cylinders 136. Therefore, when inclined to set the opening direction of the water jacket downward, discharge of sand from the opening is promoted. From sand discharge from one opening is over, the inclination of the support stand 119 is changed to set other opening downward, and the sand is discharged therefrom.

Figure 14:
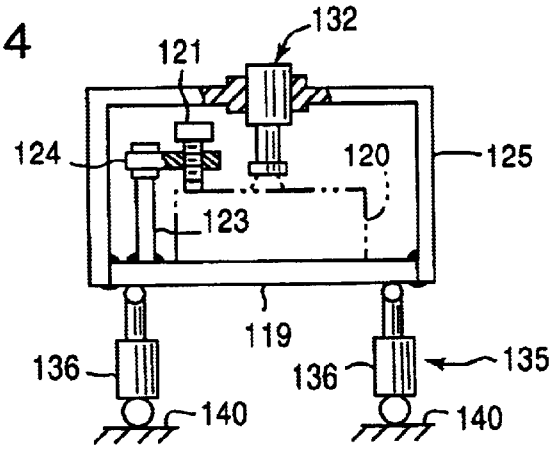
FIG. 14 is a front view showing other embodiment.

In an embodiment in FIG. 14, the inclining device 135 is directly disposed at the lower side of the support stand 119. Herein, the sand is collapsed or separated from the casting by the hammering means 132 only.

The operation herein is easily understood from the description above, and detailed description is omitted.

Figure 15:
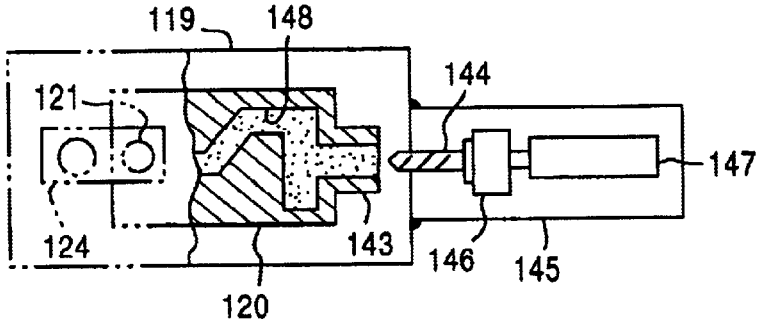
FIG. 15 is a schematic plan view showing a different embodiment.

Other embodiment shown in FIG. 15 is described. Members having the same functions as in the foregoing embodiment are identified with same reference numerals in FIG. 15, and detailed description is omitted. In the case of cylinder head of an engine as shown herein, the opening 143 of its water jacket is tubular, and the core sand packed therein is solidified like a firm plug, and it may be not easily collapsed if impact or vibration is applied to the continuous internal casting sand formed therein. Accordingly, when the solidified sand in the opening 143 is picked by a bar member 144 to collapse the tubular portion and the inner sand, the sand inside of the casting is easily moved inside by vibration or impact, and is loosened and collapsed while shaking and moving within the water jacket.

Herein, as the bar member, various examples may be considered such as gimlet moving violently back and forth or pestle with a sharp end moving around to collapse the sand, and a drill is used in the illustrated example. More specifically, a support plate 145 is welded to a support stand 119, and an electric motor 146 is mounted thereon, and a drill 144 is rotated by it. An air cylinder 147 is firmly fixed to the support plate 145 in order to move the drill 144 back and forth. To slide the electric motor 146 back and forth, although not shown, a slide rail is placed on the support plate 145. When the drill 144 is rotated and moved leftward by the air cylinder 147, the sand in the opening 143 is collapsed. When the drill 144 is further moved inward, the collapsing phenomenon extends to the inner parts of the opening 143. In this way, the sand near the opening 143 and in inner parts is collapsed so as to be easily loosened by vibration or impact. Reference numeral 148 is a water jacket.

Figure 16:
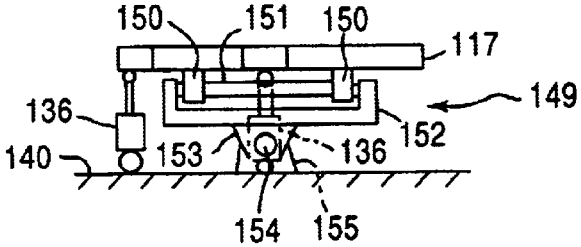
FIG. 16 is a front view showing other example of an inclining device.
Figure 17:
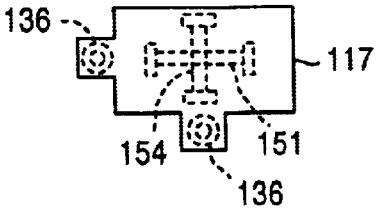
FIG. 17 is a schematic plan view of FIG. 6.

A different inclining device 149 is explained by referring to FIG. 16 and FIG. 17. In this method, a mechanism like gyroscope is disposed at the lower side of a platform 117. Brackets 150 are fixed to the lower side of the platform 117, and a first shaft 151 is supported in a state penetrating through them. A frame 152 is coupled to the shaft 151, and a bracket 153 is fixed to the lower side of the frame 152, in which a second shaft 154 is supported, and this shaft is supported on a stationary member 140 by means of a support piece 155. The two shafts 151 and 154 are crossing at right angle, and the platform 117 can be freely inclined back and forth, right and left, and is inclined by a necessary direction and angle. For the purpose of such control, hydraulic cylinders 136 same as mentioned above are disposed at two positions.

Figure 18:
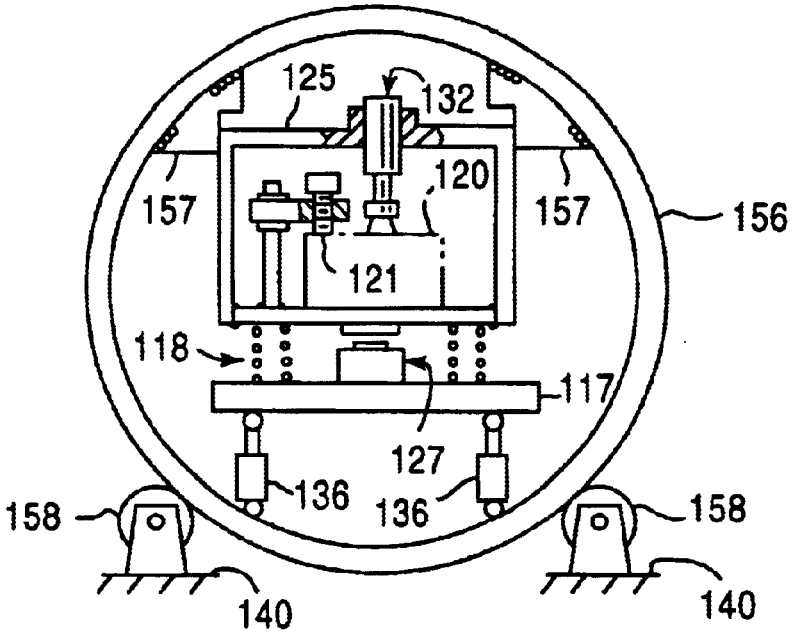
FIG. 18 is a front view showing an inverting method.
Figure 19:
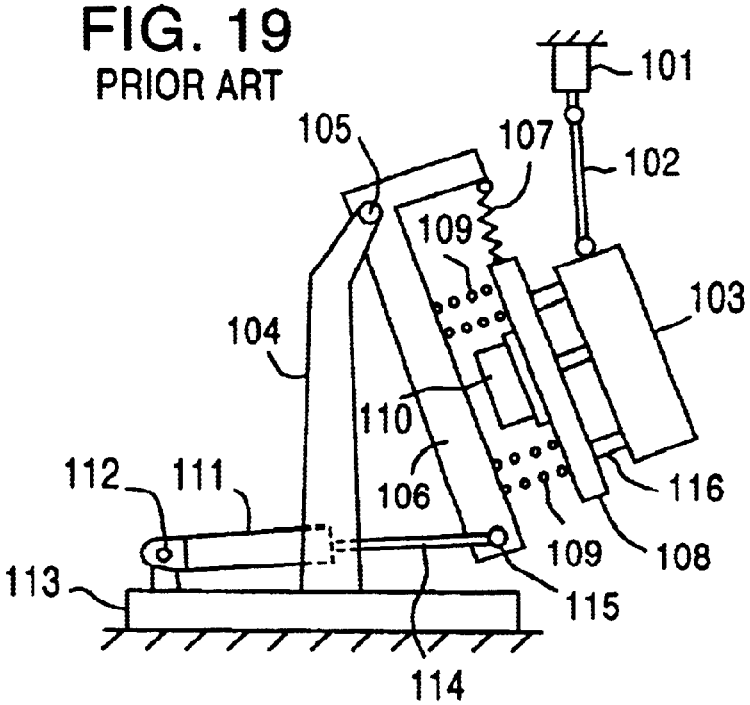
FIG. 19 PRIOR ART
FIG. 19 is a front view showing a prior art.

An embodiment in FIG. 18 is intended to invert the whole structure of the sand shake-out device having an inclining function. Various methods of inverting are possible, and herein the entire device is incorporated in a rotary ring 156. The lower sides of hydraulic cylinders 136 are coupled to the inside of the ring 156, but both shoulders of a frame 125 are held in a vertically slidable state by guide members 157 fixed to the inside of the ring 156. This is intended to allow displacement of the frame 125 by the driving device 118. Support rollers 158 are disposed on the outer circumference of the ring 156, and the rotary ring 156 is designed to be rotated by 180 degrees or more. Accordingly, in addition to discharge of sand by inclination, vibration and impact mentioned above, the discharge of sand is further encouraged by inversion. In the case of FIG. 18, by combining the vibration, hammer impact, inclination and inversion, collapse and discharge of sand are further promoted.

Further, as a method of inversion, the stationary member 140 in FIG. 11 may be used as a turntable, and the entire device can be inverted by supporting this turntable by a shaft.

What is claimed is:

1. A casting sand shake-out method characterized by fixing a casting to a support member, indirectly connecting a hammer to the support member, and hitting the casting by the hammer while vibrating the support member; wherein the vibration applied to the support member has a conveying performance in one direction, and sand sticking to the inside and outside of the casting is separated by this vibration away from the casting fixed to the support member and the sand is discharged, and an impulsive vibration is also given to the casting by the hammer to promote said separating action, thereby sending out the sand falling on the support member in one direction.

2. A casting sand shake-out method of claim 1, wherein the support member is divided into two sections, the casting is fixed on the two sections of the support member and the two sections of the support member are both vibrated.

3. A casting sand shake-out method of claim 1, wherein the support member is divided into two sections, and the casting is fixed on the two sections of the support member, and at least one of the two sections of the support member is vibrated.

4. A casting sand shake-out method of claim 3, wherein the vibration applied to both of the two sections of the support member has a conveying performance in one direction, conveying directions of vibrations of both of the two sections of the support member are set in mutually opposite directions, and after a vibration in one direction is applied to one section of the support member depending on the shape of the casting, a vibration having a conveying performance in opposite direction is applied to other section of the support member.

5. A casting sand shake-out apparatus comprising: a support member to which a casting is fixed; means for vibrating the support member; and a hammer for hitting the casting, wherein the hammer is indirectly connected to the support member, and wherein sand sticking to the inside and outside of the casting is separated away from the casting fixed to the support member and discharged by the vibrating means, and an impulsive vibration is applied to the casting by the hammer, thereby promoting said separating action; wherein the vibration of the vibrating means has a conveying performance in one direction such that sand separated from the casting is conveyed by vibration and sent outside of the apparatus.

6. A casting sand shake-out apparatus of claim 5, wherein the support member is composed of a receiving plate, and the hammer is coupled to this receiving plate, and an elastic piece is inserted in any position between the hammer and the receiving plate.

7. A casting sand shake-out apparatus of claim 6, further comprising fixing means for firmly fixing the casting to the receiving plate.

8. A casting sand shake-out apparatus of claim 7, wherein the fixing means is composed of a fixing mechanism attached to the receiving plate for pressing the casting toward the receiving plate, and the casting is pressed firmly against the receiving plate, so that the casting and the receiving plate are more securely united into one body.

9. A casting sand shake-out apparatus of claim 7, wherein the fixing means is constituted by a fixing mechanism attached to the receiving plate for pressing the casting toward the receiving plate, and a fitting relation between a protruding member provided in the receiving plate and a recess in the casting.

10. A casting sand shake-out apparatus of claim 6, wherein the receiving plate is divided into two sections, and the casting is fixed on the two sections of the receiving plate, and the two sections of the receiving plate are individually provided with vibrating means so that the two sections of the receiving plate may be both vibrated.

11. A casting sand shake-out apparatus of claim 6, wherein the receiving plate is divided into two sections, and the casting is fixed on the two sections of the receiving plate, and the two sections of the receiving plate are individually provided with vibrating means so that at least one section of the receiving plate may be vibrated.

12. A casting sand shake-out apparatus of claim 11, wherein the conveying directions of vibration of the two sections of the receiving plate are set in mutually opposite directions.

* * * * *